US006698116B2

(12) United States Patent
Waldron

(10) Patent No.: US 6,698,116 B2
(45) Date of Patent: Mar. 2, 2004

(54) GREETING CARD CARRIER FOR DATA SCANABLE CARD AND METHOD OF USING THE SAME

(75) Inventor: William Noland Waldron, Fort Scott, KS (US)

(73) Assignee: Ward-Kraft, Inc., Fort Scott, KS (US)

( * ) Notice: Subject to any disclaimer, the term of this patent is extended or adjusted under 35 U.S.C. 154(b) by 83 days.

(21) Appl. No.: 10/076,168

(22) Filed: Feb. 13, 2002

(65) Prior Publication Data

US 2003/0150141 A1 Aug. 14, 2003

(51) Int. Cl.[7] ..... G09F 1/00
(52) U.S. Cl. ..... 40/124.11; 283/99
(58) Field of Search ..... 40/124.06, 124.11, 40/124.01; 283/99, 101; 229/92.8

(56) References Cited

U.S. PATENT DOCUMENTS

| | | | | |
|---|---|---|---|---|
| 3,068,140 A | | 12/1962 | Biddle | |
| 3,697,101 A | | 10/1972 | Loos et al. | |
| 4,544,590 A | | 10/1985 | Egan | |
| 4,854,610 A | | 8/1989 | Kwiatek | 283/81 X |
| 4,890,862 A | | 1/1990 | Buchholz | 283/81 X |
| 4,982,894 A | | 1/1991 | Schmidt | 283/101 X |
| 4,983,438 A | | 1/1991 | Jameson | 283/101 X |
| 5,058,926 A | | 10/1991 | Drower | |
| 5,096,229 A | | 3/1992 | Carlson | |
| 5,098,759 A | | 3/1992 | Felix | |
| 5,129,682 A | | 7/1992 | Ashby | 283/81 |
| 5,147,043 A | * | 9/1992 | Gould | 40/124.01 X |
| 5,403,236 A | | 4/1995 | Greig | |
| 5,842,629 A | * | 12/1998 | Sprague et al. | 229/92.8 X |
| 5,918,909 A | | 7/1999 | Fiala et al. | |
| 5,954,369 A | * | 9/1999 | Seabrook | 40/124.01 X |
| 6,493,970 B1 | * | 12/2002 | McCarthy et al. | 40/124.01 |
| 6,543,809 B1 | * | 4/2003 | Kistner et al. | 283/101 X |
| 6,546,651 B2 | * | 4/2003 | Tremonti | 40/124.01 |

FOREIGN PATENT DOCUMENTS

| | | |
|---|---|---|
| EP | 0688006 | 12/1989 |
| EP | 0327754 | 8/1999 |

* cited by examiner

*Primary Examiner*—Joanne Silbermann
(74) *Attorney, Agent, or Firm*—Hovey Williams LLP

(57) ABSTRACT

A combination greeting card carrier and scanable card is provided which permits the scanable card to be pivoted between an initial position where the scanable card is displayed and has a scanable area thereon extending from the perimeter of the card in a first position and a second position where the scanable card is concealed. A hinge member pivotally connects the scanable card to the greeting card carrier. The greeting card carrier may include a recess in a front panel thereof to permit the scanable card to lay flat in its initial presentation. The greeting card carrier may include indicia conveying a preprinted desired sentiment which corresponds to the goods or services made available to the recipient when using the scanable card.

17 Claims, 1 Drawing Sheet

GREETING CARD CARRIER FOR DATA SCANABLE CARD AND METHOD OF USING THE SAME

BACKGROUND OF THE INVENTION

1. Field of the Invention

The present invention concerns a greeting card which also serves as a carrier for a data carrying card having an encoded scanable area such as an activatable calling card. More particularly, it is concerned with such a card and its method of use, whereby an encoded strip on the card extends from the perimeter of the greeting card carrier for vending and reading, retracts to be within the perimeter for mailing and presentation to the recipient, and then extends to display the encoded card when the front panel of the greeting card is pivoted away from the back panel.

2. Description of the Prior Art

Greeting cards have long been used to convey congratulations or warm sentiment to recipients. A benefit of having preprinted greeting cards is that professional artwork and corresponding textual expression is provided to the purchaser, who may then add personal notes and/or sign the card. On many occasions, the sender of the card may include cash or a check as a present to the recipient. Some cards have been designed with special pockets to hold currency intended as a gift.

While greeting cards are very popular, they are a somewhat detached form of communication. The greeting card provides a means of conveying sentiment and a message, but is not interactive. Often, the sender of a card, such as a parent or grandparent, would like to convey a gift but also be the recipient of a telephone call from the child or grandchild, for example.

More recently, telephone calling cards have been manufactured and sold at retail. These telephone calling cards and the systems for their use are described generally in U.S. Pat. Nos. 4,706,275 and 5,918,909, the disclosures of which are incorporated herein by reference. The telephone calling cards are typically displayed at retail attached to a cardboard panel which acts as a carrier. A portion of the telephone calling card carrying a magnetically encoded strip extends from the margin of the cardboard carrier. At the retail checkout stand, the telephone calling card is activated after the purchaser pays the required retail amount by "swiping" the encoded strip through an electronic reader. This activates the account for the card from a remote computer for a metered amount of telephone usage corresponding to the personal identification number or PIN particular to and identified on the card. This credits the account so that upon purchase, telephone usage is "prepaid". The user then dials in the PIN in the process of using the card, with the usage being deducted from the computer-held account until exhausted. When the available number of minutes of usage have been exhausted, any calls in progress are automatically terminated, and no further calls can be initiated from that card unless additional minutes are purchased for that PIN. In the case of sample cards or other prepaid cards, an account may be created without the necessity of scanning the card upon purchase. While these encoded areas are typically magnetically encoded strips, the encoded areas may also be provided as optically scannable blocks may also be employed to carry the account information from which purchases of goods or services may be deducted.

SUMMARY OF THE INVENTION

It is an object of the present invention to provide a means of giving a gift account card which is convertible for other goods and services and may be purchased in combination with a greeting card.

It is another object of the present invention to use a greeting card as a carrier for a card having a data encoded area whereby the encoded area card may be coupled to the greeting card to provide a single product for purchase and extend externally to the perimeter of the greeting card for activation, be retracted into a hidden position within the perimeter of the greeting card for mailing to the recipient, and then revealed when the greeting card is opened.

It is an object of the present invention to provide a readily manufacturable and saleable combination greeting card and encoded area card which has lay-flat characteristics during shipping to the distributor or retailer, and avoiding excess packaging and waste.

It is a further object to provide a greeting card which allows the sender to convey a prepaid telephone calling card, thereby facilitating and encouraging return interactive contact by the recipient to the sender.

These and other objects have been largely met by the greeting card carrier for data scannable card of the present invention. By "scannable card", it is understood that as described in U.S. Pat. No. 5,918,909, the card itself is merely read by a scanner, but that an account corresponding to the card is activated after scanning at the point of purchase. The present invention provides a combined product which may be purchased as a unit at retail, thereby avoiding waste normally found in the provision of a separate carrier packaging for the scanable card. It satisfies the desire of the purchaser to convey a sentiment and gift. When the scanable card is a telephone calling card, it provides a potential return benefit to the sender of the greeting card carrier by suggesting, directly or subliminally, that the recipient should use the telephone calling card to contact the sender. The invention thus combines a greeting card and a telephone calling card to be regarded as a "give-me-a-call-card." One benefit of the present invention is that the encoded card, once activated, may remain connected to the carrier but hidden between front and back panels during mailing and initial presentation to the recipient, whereupon opening of the card in a generally upright position causes the hingably mounted scanable card to extend for full display. In this way, the greeting card carrier of the present invention satisfies the desire for a sequential presentation with initial hiding of the gift which is then revealed only after opening, as well as providing interest by motion during opening.

The greeting card carrier of the present invention broadly includes a carrier having a front panel and a rear panel connected along a hinge line, a hinge member, and a second card having a scanable data encoded area coupled by the hinge element to the carrier, whereby in a first extended position the scanable card has a portion extending outwardly from the perimeter of the panels of the carrier which bears the scanable area and a second retracted position is inward of the perimeter of the panels and hidden from view. The hinge element may be incorporated in one of the front and rear panels of the carrier, or alternatively provided separately and preferably includes an adhesive to hold the scanable card until removal is desired. The hinge element is preferably provided on the rear panel, so that the scanable card flips forwardly when the carrier is opened. The front panel may include a recessed area in the perimeter so that the activatable card is received in registry therewith in an initial position at the time of purchase to reveal the scanable area for scanning, and then moved into a concealed position by user so that the carrier readily fits within an envelope and the scanable card is concealed by the greeting card until the front panel is opened.

DESCRIPTION OF THE PREFERRED EMBODIMENT

Figure 1:
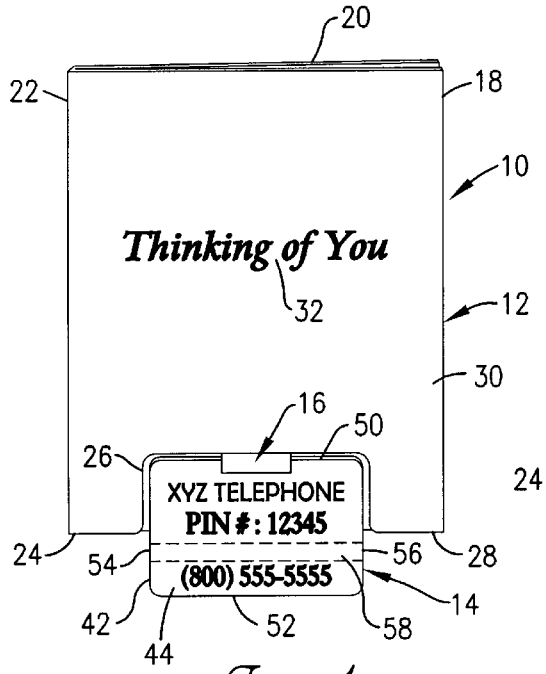
FIG. 1 is a front perspective view of the greeting card carrier and scanable card of the present invention with the scanable card having a portion extending beyond the perimeter of the greeting card carrier for scanning at the time of purchase and account activation, the scanable area being on the back side of the scanable card and shown in dashed lines.

Referring now to the drawings, a combination greeting card carrier and scanable card 10 in accordance with the present invention broadly includes a greeting card carrier 12, a scanable card 14, and a hinge member 16 which releasably connects the scanable card 14 to the carrier 12 and allows the former to pivot relative to the latter.

The greeting card carrier 12 typically includes an integral front panel 18 and a rear panel 20, both preferably of paper, cardboard or plastic. The front panel 18 and rear panel 20 are foldably connected along a hinge line 22. While an upright hinge line 22 is shown in the drawings, it may be appreciated that a transverse or horizontal hinge line 22 would also be appropriate. The front panel 18 includes a perimeter 24 which may optionally have a recess 26 cut out along the bottom margin 28. The front panel 18 has a front face 30 on which indicia 32 such as artwork or text to make the carrier 12 appealing to the purchaser and recipient, and a rear face 34 which may also include indicia or remain blank. The rear panel 20 includes a perimeter 36 within which an inside face 38 against which the scanable card 14 is received, and a back face on the other side of the rear panel 20 which may be provided with printer's identification, pricing, bar-coding and other indicia. The area of the rear panel 20 is preferably greater than the area of the front panel 18 when the front panel 18 includes the recess 26.

The hinge member 16 may be formed from a tab cut in the rear panel 20 and provided with adhesive for temporarily holding the scanable card 14, or by a separate member such as tape 40 provided with adhesive for attachment to both one of the front panel rear face 30 and the inside face 38 of the rear panel 20 and the scanable card 14.

The scanable card 14 is a preferably plastic or plastic-laminated having a surrounding edge 42 defining therein an area with a front face 44 and a back face 46, either or both of which may have indicia 48 imprinted thereon to identify the account holder from which goods or services, such as telephone services, may be redeemed. The edge 42 includes a top edge 50, a bottom edge 52, and side edges 54 and 56. The back face 46 is provided with a scanable area 58, shown in dashed lines in FIG. 1. The scanable area 58 may be a magnetically encoded and readable strip, a bar code which is optically scanable, or an encoded radio frequency identification (RFID) microchip including a power source for causing the microchip to emit a signal or a transponder which emits a signal when interrogated. In the case of a telephone calling card, for example, a printed identification number corresponding to the scanable card 14 and a telephone number for accessing telephone service is also imprinted on one of the front face 44 and back face 46.

The hinge member 16 attaches the scanable card 14 to the greeting card carrier 12 in such a manner that the edge 42 of the scanable card 14 is initially nested within the recess 26 of the front panel 18 in an extended position, with the bottom edge 52 and the scanable area 58 extending beyond the bottom margin 28 and beyond the recess 26, and also beyond the lower edge of the perimeter 36 of the rear panel 20, as shown in FIG. 1. In this way, the scanable area 58 may be easily read by a scanner at the place of purchase to activate the account without the necessity of opening the front panel 18 relative to the rear panel 20 or other cumbersome positioning. The scanable card 14 is visibile to the purchaser, who would naturally wish to ensure that the scanable card is included at the time of purchase, and can see the indicia 48 identifying a source or provider of the services. Moreover, this positioning of the scanable card avoids overlap between the front panel 18 and the scanable card 14, providing improved lay-flat characteristics. Thus, the hinge member 16 preferably connects the scanable card 14 to either the rear face 34 of the front panel 18 or the inside face 38 as illustrated in the drawings.

Figure 2:
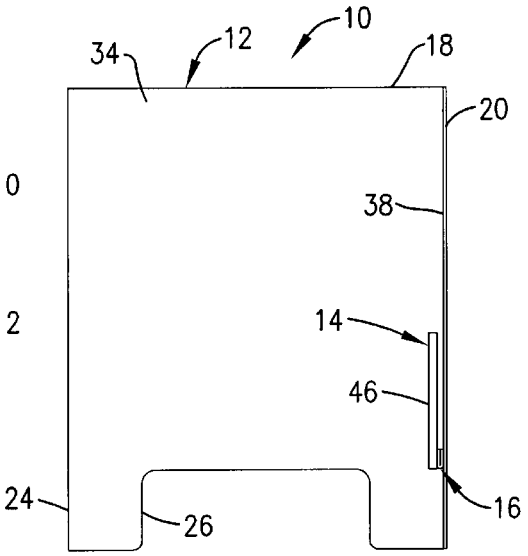
FIG. 2 is a right side elevational view of the greeting card carrier and scanable card of FIG. 1, showing the front panel of the carrier in an open position after opening along the hinge line and the scanable card pivoted on the hinge member into a position for concealment once the front panel is closed.
Figure 3:
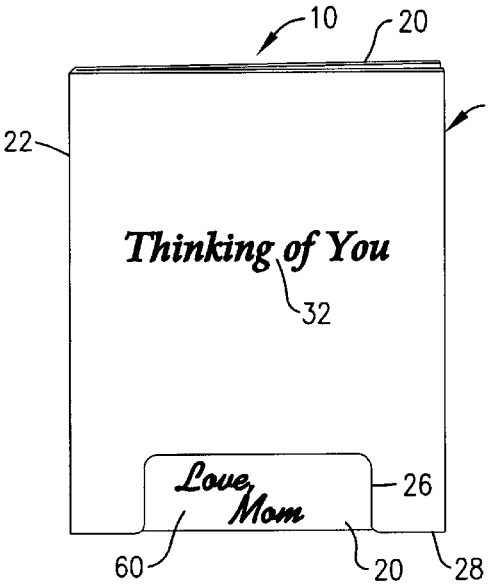
FIG. 3 is a front perspective view similar to FIG. 1, but showing the appearance of the greeting card carrier when the scanable card is in the concealed position.
Figure 4:
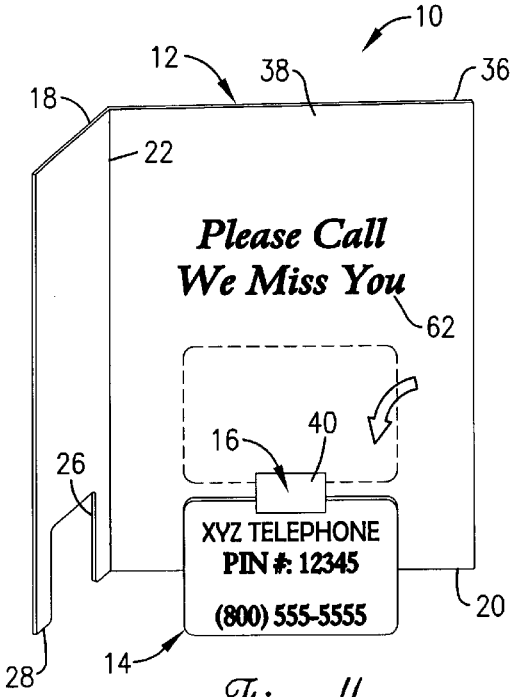
FIG. 4 is a front perspective view of the greeting card carrier and the scanable card after the front panel is opened and the scanable card returns to the first position.

After the combination greeting card carrier and scanable card 10 is purchased and activated, the purchaser pivots the scanable card 14 to the concealed position illustrated in FIG. 2 and in dashed lines in FIG. 4, whereby the scanable card 14 is no longer located in the recess 26, but rather is pivoted up and out of the initial view of the recipient as shown in FIG. 3. This position allows a portion 60 of the rear panel 12 to be seen by the recipient during initial presentation. This portion 60 may be preprinted or receive an inscription of the purchaser which is then visible through the recess 26. When the recipient unfolds the front panel 18 from the rear panel 20, the hinge member 16 allows the scanable card 14 to drop from the concealed position as shown in dashed lines to the extended position as shown in solid lines in FIG. 4. When extended, the scanable card 14 is positioned to display the front face 44, as well as any indicia 62 printed on the rear panel 20's card-carrying face 38. The recipient may then detach the card from the hinge member 16. Because the scanable card's account was activated at the time of purchase, the recipient is ready to use the scanable card to purchase goods or services.

The combination greeting card carrier and scanable card 10 in 10 accordance with the present invention thus facilitates the retail process and handling, the desire of the purchaser to convey a gift and a sentiment on a greeting card in a ready-to-use form, and makes use of the card easily accessible by the recipient. When a bar code corresponding to the product and price is printed on the back face of the rear panel 20, the price for the combined product is easily accessed for inventory purposes for a single product, and the lay-flat characteristics enhance the shipping and storage capability as opposed to having two separate products. In the case of a telephone calling card, the purchaser/sender may encourage a return call from the recipient. The combination greeting card carrier and scanable card 10 makes an attractive presentation both at the point of purchase and satisfies a desire of the sender to conceal the contents of an envelope during shipping to avoid theft and at the time of initial presentation to provide a surprise to the recipient.

Although preferred forms of the invention have been described above, it is to be recognized that such disclosure is by way of illustration only, and should not be utilized in a limiting sense in interpreting the scope of the present invention. For example as noted above, the rear panel 20 may be scored or cut and provided with adhesive for attachment of the scanable card 14 to the tab thereby created, the tab forming a hinge member 16 from the cardstock of the greeting card carrier 12 to allow the scanable card 14 to pivot from the extended position of FIG. 1 to the concealed position of FIGS. 2 and 3. In addition, the provision of recess 26, while beneficial for facilitating marketing of the combination card hereof, such a recess is an optional rather than a necessary feature. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. A combination greeting card carrier and scanable gift card comprising;

a greeting card carrier including a front panel and a rear panel having a perimeter pivotally interconnected along a hinge line, said front panel having a recess;

a scanable card including a scanable area configured for reading by a scanner and at least one edge;

a hinge member pivotally connecting the scanable card to one of the front panel and rear panel and positioned for positioning the scanable card to allow pivoting of the scanable card relative to the greeting card carrier between a first extended position with said at least one edge and said scanable area positioned beyond said rear panel perimeter and a second concealed position with the at least one edge and said scanable area positioned within said perimeter of said rear panel and covered by said front panel; and said hinge member and scanable card are positioned so that said scanable card is aligned with said front panel in nesting relationship within said recess in said first extended position and is out of registry with said recess and concealed between the front panel and rear panel in said concealed position.

2. A combination greeting card carrier and scanable card as set forth in claim 1, wherein said rear panel has an inside face and said hinge member is connected to said inside face.

3. A combination greeting card carrier and scanable card as set forth in claim 2, wherein said hinge member is a tape provided with adhesive.

4. A combination greeting card carrier and scanable card as set forth in claim 1, wherein said scanable card is a telephone calling card.

5. A combination greeting card carrier and scanable card as set forth in claim 1, wherein said scanable card lays flat within said greeting card when in said concealed position.

6. A combination greeting card carrier and scanable card as set forth in claim 1, wherein said scanable card when in said concealed position reveals an inscription.

7. A combination greeting card carrier and scanable card as set forth in claim 1, wherein said greeting card with said scanable card fits within an envelope.

8. A method of transferring a gift comprising the steps of;

providing a combination greeting card carrier and scanable card pivotally coupled to the greeting card by a hinge member, said scanable card having a scanable area encoded in with account information redeemable for other goods and services, said greeting card including a front panel and a rear panel connected along a hinge line with one of said front and rear panels having a recess;

scanning said scanable area to activate an account at a remote location;

pivoting said scanable card relative to said greeting card carrier while coupled to said hinge member from an exposed position in registry with said recess to conceal the scanable card within the greeting card carrier between the front panel and the rear panel so that said scanable card is not in registry with said recess; and opening said greeting card carrier by pivoting said front panel relative to said rear panel to reveal said scanable card.

9. A method of transferring a gift as set forth in claim 8, further including the step of detaching the scanable card from the greeting card after opening the front panel relative to the rear panel to reveal the scanable card.

10. A method of transferring a gift as set forth in claim 8, including a further step of inserting said combination in an envelope prior to the step of opening said greeting card.

11. A method of transferring a gift as set forth in claim 8, including a further step of applying an inscription to said greeting card in an area created by said recess prior to the step of scanning said scanable area.

12. A method of transferring a gift as set forth in claim 8, including a further step of revealing an inscription after the step of pivoting said scanable card.

13. A greeting card and gift card combination, comprising;

a greeting card having a front and rear panel, with one of said front and rear panels having a recess provided therein and one of said front and rear panels having a hinge for releaseably securing a gift card to said one of said front and rear panels with said hinge;

said gift card separate from said greeting card, said gift card releaseably connected to one of said front and rear panels with said hinge and disposed at least partially within an area of said recess; and said gift card movable between an exposed position and a concealed position such that said gift card is out of registry with said recess in said concealed position.

14. A greeting card and gift card combination as recited in claim 13, wherein said gift card is a telephone calling card.

15. A greeting card and gift card combination as recited in claim 13, wherein said gift card lays flat within said greeting card when in said concealed position.

16. A greeting card and gift card combination as recited in claim 13, wherein said greeting card with said gift card fits within an envelope.

17. A greeting card and gift card combination as recited in claim 13, wherein said gift card when in said concealed position reveals an inscription.

* * * * *